US009498687B2

(12) United States Patent
Nakamura

(10) Patent No.: US 9,498,687 B2
(45) Date of Patent: Nov. 22, 2016

(54) GOLF CLUB SHAFT

(71) Applicant: DUNLOP SPORTS CO. LTD., Kobe-shi, Hyogo (JP)

(72) Inventor: Hirotaka Nakamura, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 0 days.

(21) Appl. No.: 14/447,119

(22) Filed: Jul. 30, 2014

(65) Prior Publication Data

US 2015/0038254 A1 Feb. 5, 2015

(30) Foreign Application Priority Data

Jul. 31, 2013 (JP) ..... 2013-158446

(51) Int. Cl.
*A63B 53/10* (2015.01)

(52) U.S. Cl.
CPC ..... *A63B 53/10* (2013.01); *A63B 60/42* (2015.10); *A63B 2209/02* (2013.01); *A63B 2209/023* (2013.01)

(58) Field of Classification Search
CPC ..... A63B 53/10; A63B 2209/02; A63B 2209/023
See application file for complete search history.

(56) References Cited

U.S. PATENT DOCUMENTS 5,093,162 A * 3/1992 Fenton ..... A63B 53/10 138/130
5,437,450 A * 8/1995 Akatsuka ..... A63B 53/10 273/DIG. 23
5,626,529 A * 5/1997 Roy ..... A63B 53/10 156/188
6,273,830 B1 * 8/2001 Takemura ..... A63B 53/10 428/36.9
6,306,047 B1 * 10/2001 Kusumoto ..... A63B 53/10 428/36.3
7,338,386 B2 * 3/2008 Nakajima ..... A63B 53/10 473/319
7,500,922 B2 * 3/2009 Takeuchi ..... A63B 53/10 473/319
7,803,063 B2 * 9/2010 Kumamoto ..... A63B 53/10 473/319
2009/0029792 A1 1/2009 Kumamoto
2010/0041492 A1 * 2/2010 Rice ..... A63B 53/10 473/289
2010/0285897 A1 * 11/2010 Takeuchi ..... A63B 53/10 473/319
2014/0106895 A1 * 4/2014 Hasegawa ..... A63B 53/10 473/319

FOREIGN PATENT DOCUMENTS

JP 2001-346925 A 12/2001
JP 4112722 B2 7/2008
JP 2009-022622 A 2/2009

* cited by examiner

*Primary Examiner* — Stephen Blau
(74) *Attorney, Agent, or Firm* — Birch, Stewart, Kolasch & Birch, LLP

(57) ABSTRACT

A shaft 6 is formed by a plurality of prepreg sheets s1, s2, s3, s4, s5, s6, s7, s8 and s9. These prepreg sheets include full length sheets and partial sheets partially provided in the axial direction of the shaft. The full length sheets include a full length hoop sheet s7. The partial sheets include glass fiber reinforced sheets s1, s4. In the shaft 6, a volume ratio Vf of the hoop layer in a specific tip part Tx is equal to or greater than 2.5% and less than 10%. The shaft 6 is light-weight and has a high degree of design freedom of a position of a center of gravity. The shaft 6 is excellent in strength of a tip part.

14 Claims, 8 Drawing Sheets

GOLF CLUB SHAFT

The present application claims priority on Patent Application No. 2013-158446 filed in JAPAN on Jul. 31, 2013, the entire contents of which are hereby incorporated by reference.

BACKGROUND OF THE INVENTION

Field of the Invention

The present invention relates to a golf club shaft.

Description of the Related Art

A so-called carbon shaft has been known as a golf club shaft. A sheetwinding method has been known as a method for manufacturing the carbon shaft.

A prepreg includes a matrix resin and a fiber. Many types of prepregs exist. A plurality of prepregs having different resin contents have been known. In the present application, the prepreg is also referred to as a prepreg sheet or a sheet.

In the sheetwinding method, the type of a sheet, the disposal of the sheet, and the orientation of a fiber can be selected. A sheet constitution is designed corresponding to desired characteristics of a shaft.

Japanese Patent No. 4112722 discloses a golf club shaft including a circumferential reinforcing fiber layer having a total thickness set to a range of 10 to 30% based on the total thickness of the shaft.

SUMMARY OF THE INVENTION

A head is attached to a tip part of a shaft. Therefore, high strength is required for the tip part of the shaft. Meanwhile, the amount of a prepreg to be used is restricted in a lightweight shaft. In a lightweight shaft having a reinforced tip part, a prepreg is apt to be concentrated on a tip side. In this case, the center of gravity of the shaft is apt to approach the tip. In the lightweight shaft, a degree of design freedom is restricted. It is difficult to achieve both a degree of freedom of the position of the center of gravity and weight saving.

It is an object of the present invention to provide a lightweight golf club shaft having a high degree of freedom of a position of a center of gravity.

A preferable shaft includes a plurality of prepreg sheets. The prepreg sheets include a full length sheet, and a partial sheet partially provided in an axial direction of the shaft. The full length sheet includes a full length hoop sheet. The partial sheet includes a glass fiber reinforced sheet.

A point separated by 90 mm from a tip of the shaft is defined as T, and a region between the point T and the tip of the shaft is defined as a specific tip part. Preferably, a volume ratio Vf of a hoop layer in the specific tip part is 2.5% or greater and less than 10%.

Preferably, the glass fiber reinforced sheet includes a tip glass fiber part positioned in the specific tip part.

A total thickness of the shaft is defined as Ts, and a portion having a thickness of Ts/3 from an inner surface of the shaft is defined as a specific inner part. Preferably, the at least one glass fiber reinforced sheet is disposed in the specific inner part.

Preferably, the glass fiber reinforced sheet includes an innermost layer forming part constituting an inner surface of the shaft.

Preferably, a weight of the shaft is less than 50 g.

DESCRIPTION OF THE PREFERRED EMBODIMENTS

The present invention will be described later in detail based on preferred embodiments with appropriate reference to the drawings.

In the present application, an "axial direction" means an axial direction of a shaft. In the present application, a "radial direction" means a radial direction of the shaft.

Figure 1:
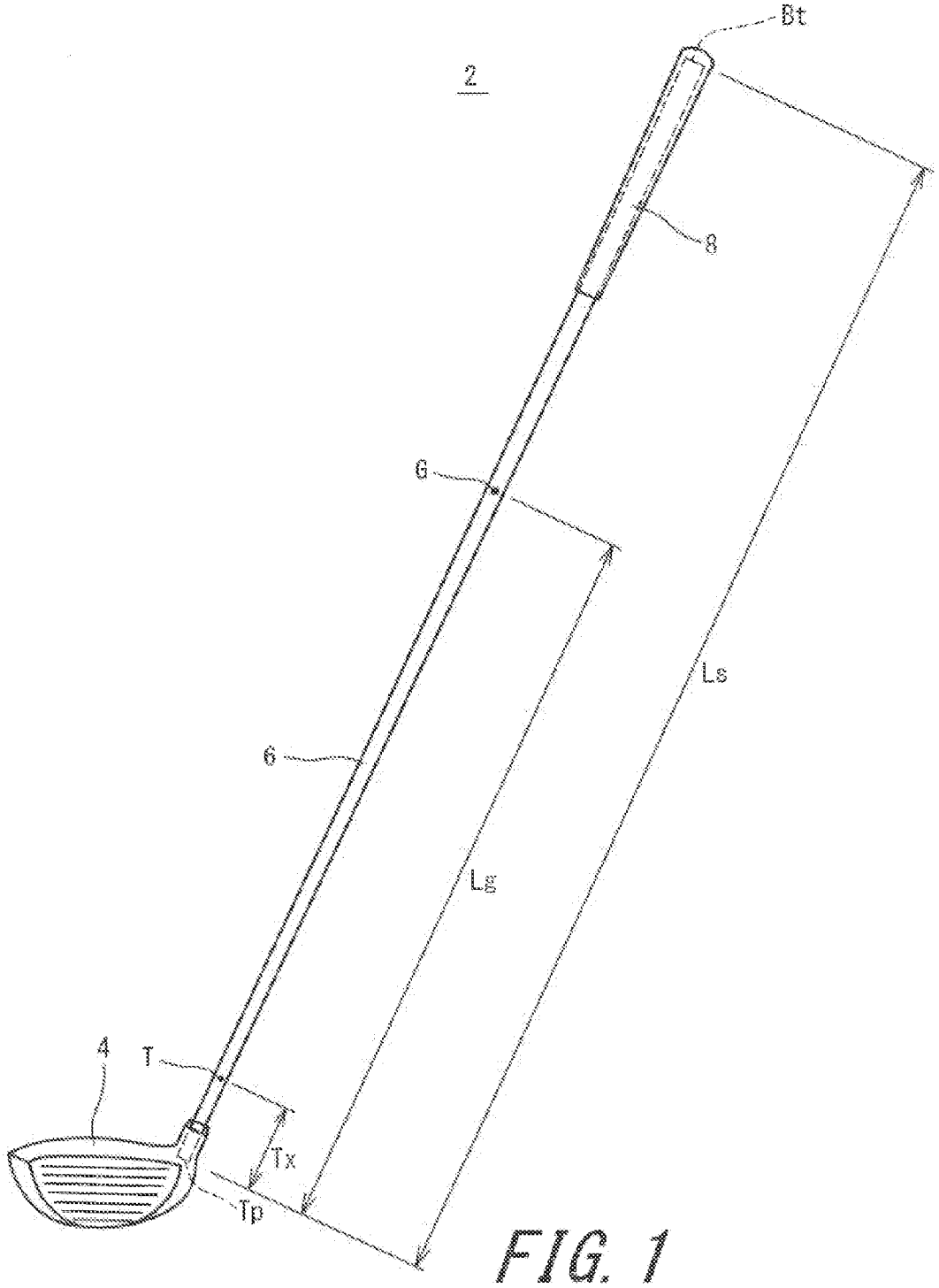
FIG. 1 shows a golf club including a shaft according to a first embodiment.

FIG. 1 shows a golf club 2 according to one embodiment of the present invention. The golf club 2 includes a head 4, a shaft 6, and a grip 8. The head 4 is attached to a tip part of the shaft 6. The grip 8 is attached to a butt end part of the shaft 6. The head 4 has a hollow structure. The head 4 include a wood type head. The golf club 2 is a driver (No. 1 wood).

The embodiment is effective in an improvement in flight distance performance. In respect of a flight distance, a club length is preferably equal to or greater than 43 inch. In respect of the flight distance, a preferable head 4 is a wood type golf club head. Preferably, the golf club 2 is a wood type golf club.

The shaft 6 includes a laminate of fiber reinforced resin layers. The shaft 6 is a tubular body. The shaft 6 has a hollow structure. As shown in FIG. 1, the shaft 6 has a tip (tip end) Tp and a butt end Bt. The tip end Tp is positioned in the head 4. The butt end Bt is positioned in the grip 8.

The tip part of the shaft 6 is inserted into a hosel hole of the head 4. The axial direction length of a portion of the shaft 6 inserted into the hosel hole is usually 25 mm or greater and 70 mm or less.

A shaft length is shown by a double-pointed arrow Ls in FIG. 1. The shaft length Ls is an axial direction distance between the tip end Tp and the butt end Bt. An axial direction distance between the tip end Tp and a center of gravity G of the shaft is shown by a double-pointed arrow Lg in FIG. 1. The center of gravity G of the shaft is a center of gravity of the simple shaft 6. The center of gravity G is positioned on an axis line of the shaft. A club length is shown by a double-pointed arrow L1 in FIG. 1. A method for measuring the club length L1 will be described later.

The shaft 6 is a so-called carbon shaft. The shaft 6 is preferably produced by curing a prepreg sheet. In the prepreg sheet, fibers are oriented substantially in one direction. Thus, the prepreg in which the fibers are oriented substantially in one direction is also referred to as a UD prepreg. The term "UD" stands for uni-direction. Prepregs which are not the UD prepreg may be used. For example, fibers contained in the prepreg sheet may be woven.

The prepreg sheet includes a fiber and a resin. The resin is also referred to as a matrix resin. The fiber is typically a carbon fiber. The matrix resin is typically a thermosetting resin.

The shaft 6 is manufactured by a so-called sheetwinding method. In the prepreg, the matrix resin is in a semicured state. The shaft 6 is obtained by winding and curing the prepreg sheet.

In addition to an epoxy resin, a thermosetting resin other than the epoxy resin and a thermoplastic resin or the like may also be used as the matrix resin of the prepreg sheet. In respect of the strength of the shaft, the matrix resin is preferably the epoxy resin.

Figure 2:
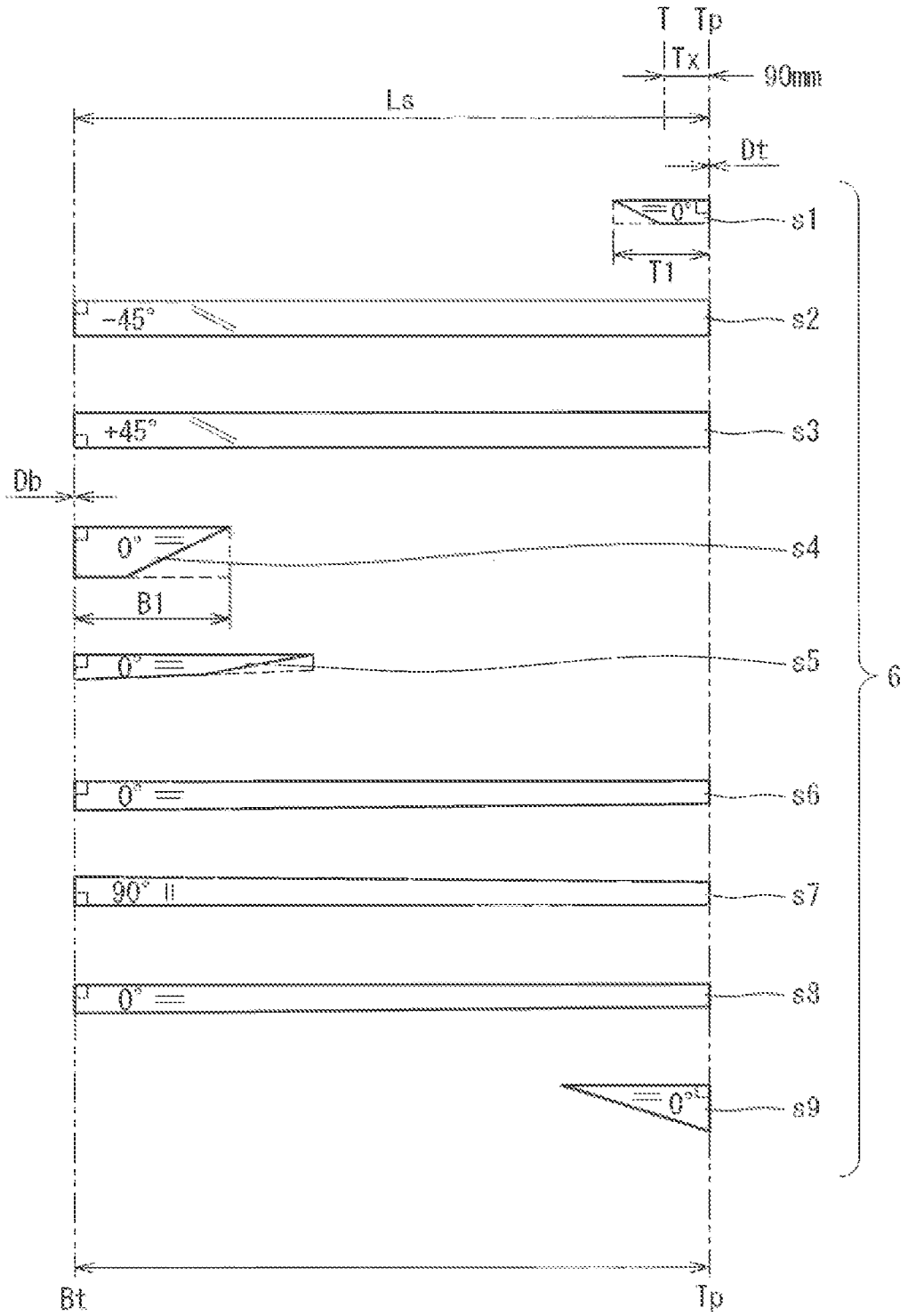
FIG. 2 is a developed view of the shaft of the first embodiment.

FIG. 2 is a developed view (sheet constitution view) of the prepreg sheets constituting the shaft 6. The shaft 6 includes a plurality of sheets. The shaft 6 includes nine sheets of a first sheet s1 to a ninth sheet s9. The developed view shown in FIG. 2 shows the sheets constituting the shaft in order from the radial inner side of the shaft. These sheets are wound in order from the sheet positioned on the uppermost side in the developed view. In FIG. 2, the horizontal direction of the figure coincides with the axial direction of the shaft. In FIG. 2, the right side of the figure is a tip end Tp side of the shaft. In FIG. 2, the left side of the figure is a butt end Bt side of the shaft.

A point separated by 90 mm in the axial direction from the tip end Tp is shown by symbol T in FIGS. 1 and 2. In the present application, a region between the tip end Tp and the point T is also referred to as a specific tip part Tx.

The developed view shows not only the winding order of the sheets but also the disposal of each of the sheets in the axial direction of the shaft. For example, in FIG. 2, ends of the sheets s1 and s9 are positioned at the tip end Tp of the shaft. For example, in FIG. 2, the ends of the sheets s4 and s5 are positioned at the butt end Bt of the shaft.

The term "layer" and the term "sheet" are used in the present application. The "layer" is termed after being wound. Meanwhile, the "sheet" is termed before being wound. The "layer" is formed by winding the "sheet". That is, the wound "sheet" forms the "layer". In the present application, the same symbol is used in the layer and the sheet. For example, a layer formed by a sheet s1 is a layer s1.

The shaft 6 includes a straight layer, a bias layer, and a hoop layer. An orientation angle Af of the fiber is described for each of the sheets in the developed view of the present application. The orientation angle Af is an angle to the axial direction the shaft.

A sheet described as "0 degree" constitutes the straight layer. The sheet for the straight layer is also referred to as a straight sheet in the present application.

The straight layer is a layer in which the orientation of the fiber is substantially 0 degree to the axial direction of the shaft. The orientation of the fiber may not be completely set to 0 degree to the axial direction of the shaft due to an error or the like in winding. Usually, in the straight layer, an absolute angle θa is equal to or less than 10 degrees.

The absolute angle θa is the absolute value of the orientation angle Af. For example, "the absolute angle θa is equal to or less than 10 degrees" means that "the angle Af is −10 degrees or greater and +10 degrees or less".

In the embodiment of FIG. 2, the straight sheets are the sheet s1, the sheet s4, the sheet s5, the sheet s6, the sheet s8, and the sheet s9.

The bias layer is highly correlated with the torsional rigidity and torsional strength of the shaft. Preferably, a bias sheet includes a two-sheet pair in which orientation angles of fibers are inclined in opposite directions. In respect of the torsional rigidity, the absolute angle θa of the bias layer is preferably equal to or greater than 15 degrees, more preferably equal to or greater than 25 degrees, and still more preferably equal to or greater than 40 degrees. In respects of the torsional rigidity and flexural rigidity, the absolute angle θa of the bias layer is preferably equal to or less than 60 degrees, and more preferably equal to or less than 50 degrees.

In the shaft 6, the sheets constituting the bias layer are the second sheet s2 and the third sheet s3. As described above, in FIG. 2, the angle Af is described in each sheet. The plus (+) and minus (−) in the angle Af show that the fibers of the bias sheets are inclined in opposite directions. In the present application, the sheet for the bias layer is also merely referred to as a bias sheet. The sheet pair is constituted by the sheets s2 and s3. The sheet pair constitutes a united sheet to be described later.

In FIG. 2, the inclination direction of the fiber of the sheet s3 is equal to the inclination direction of the fiber of the sheet s2. However, as described later, the sheet s3 is turned over, and applied on the sheet s2. As a result, the direction of the angle Af of the sheet s2 and the direction of the angle Af of the sheet s3 are opposite to each other.

In the embodiment of FIG. 2, the angle of the sheet s2 is −45 degrees and the angle of the sheet s3 is +45 degrees. However, conversely, it should be appreciated that the angle of the sheet s2 may be +45 degrees and the angle of the sheet s3 may be −45 degrees.

In the shaft 6, the sheet constituting the hoop layer is the seventh sheet s7. Preferably, the absolute angle θa in the hoop layer is substantially 90 degrees to the axis line of the shaft. However, the orientation direction of the fiber to the axial direction of the shaft may not be completely set to 90 degrees due to an error or the like in winding. Usually, in the hoop layer, the absolute angle θa is 80 degrees or greater and 90 degrees or less. In the present application, the prepreg sheet for the hoop layer is also referred to as a hoop sheet.

The number of the layers to be formed from one sheet is not limited. For example, if the number of plies of the sheet is 1, the sheet is wound by one round in a circumferential direction. If the number of plies of the sheet is 1, the sheet forms one layer at all positions in the circumferential direction of the shaft.

For example, if the number of plies of the sheet is 2, the sheet is wound by two rounds in the circumferential direction. If the number of plies of the sheet is 2, the sheet forms two layers at the all positions in the circumferential direction of the shaft.

For example, if the number of plies of the sheet is 1.5, the sheet is wound by 1.5 rounds in the circumferential direction. If the number of plies of the sheet is 1.5, the sheet forms one layer at the circumferential position of 0 to 180 degrees, and forms two layers at the circumferential position of 180 degrees to 360 degrees.

In respect of suppressing winding fault such as wrinkles, a sheet having a too large width is not preferable. In this respect, the number of plies of one bias sheet is preferably equal to or less than 4, and more preferably equal to or less than 3. In respect of the working efficiency of the winding process, the number of plies of the bias sheet is equal to or greater than 1.

In respect of suppressing winding fault such as wrinkles, a sheet having a too large width is not preferable. In this respect, the number of plies of one straight sheet is preferably equal to or less than 4, more preferably equal to or less than 3, and still more preferably equal to or less than 2. In respect of the working efficiency of the winding process, the number of plies of the straight sheet is preferably equal to or greater than 1. The number of plies may be 1 in all the straight sheets.

In a full length sheet, winding fault is apt to be generated. In respect of suppressing the winding fault, the number of plies of one sheet in all full length straight sheets is preferably equal to or less than 2. The number of plies may be 1 in all the full length straight sheets.

In respect of suppressing winding fault such as wrinkles, a sheet having a too large width is not preferable. In this respect, the number of plies of the hoop sheet is preferably equal to or less than 4, more preferably equal to or less than 3, and still more preferably equal to or less than 2. In respect of the working efficiency of the winding process, the number of plies of one hoop sheet is preferably equal to or greater than 1. The number of plies may be equal to or less than 2 in all the hoop sheets.

In the full length sheet, winding fault is apt to be generated. In respect of suppressing the winding fault, the number of plies of one sheet in all full length hoop sheets is preferably equal to or less than 2. In all the full length hoop sheets, the number of plies may be 1.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a surface of a mold release paper side", and the surface on which the resin film is applied is also referred to as "a surface of a film side".

In the developed view of the present application, the surface of the film side is the front side. That is, in FIG. 2, the front side of the figure is the surface of the film side, and the back side of the figure is the surface of the mold release paper side. In FIG. 2, the direction of a line showing the direction of the fiber of the sheet s2 is the same as the direction of a line showing the direction of the fiber of the sheet s3. However, in the case of the stacking to be described later, the sheet s3 is reversed. As a result, the directions of the fibers of the sheets s2 and s3 are opposite to each other. Therefore, the directions of the fibers of the sheets s2 and s3 are opposite to each other. In light of this point, in FIG. 2, the direction of the fiber of the sheet s2 is described as "−45 degrees", and the direction of the fiber of the sheet s3 is described as "+45 degrees".

In order to wind the prepreg sheet, the resin film is first peeled. The surface of the film side is exposed by peeling the resin film. The exposed surface has tacking property (tackiness). The tacking property is caused by the matrix resin. That is, since the matrix resin is in a semicured state, the tackiness is developed. The edge part of the exposed surface of the film side is also referred to as a winding start edge part. Next, the winding start edge part is applied to a wound object. The winding start edge part can be smoothly applied due to the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is previously peeled, then, the winding start edge part is applied to the wound object, and then, the mold release paper is peeled. That is, the resin film is previously peeled. After the winding start edge part is applied to the wound object, the mold release paper is peeled. The procedure suppresses wrinkles and winding fault of the sheet. This is because the sheet to which the mold release paper is applied is supported by the mold release paper, and is less likely to cause wrinkles. The mold release paper has flexural rigidity higher than the flexural rigidity of the resin film.

In the embodiment of FIG. 2, a united sheet is formed. The united sheet is formed by stacking two or more sheets.

In the embodiment of FIG. 2, two united sheets are formed. A first united sheet is formed by stacking the sheet s3 on the sheet s2. A second united sheet is formed by stacking the sheet s7 on the sheet s8. The hoop sheet s7 is wound in a state of the united sheet. The winding fault of the hoop sheet is suppressed by the winding method. Examples of the winding fault include the splitting of the sheet, the error of the angle Af, and wrinkles.

As described above, in the present application, the sheet and the layer are classified by the orientation angle of the fiber. Furthermore, in the present application, the sheet and the layer are classified by the axial direction length of the shaft.

In the present application, a layer substantially wholly disposed in the axial direction of the shaft is referred to as a full length layer. In the present application, a sheet substantially wholly disposed in the axial direction of the shaft is referred to as a full length sheet. The wound full length sheet forms the full length layer.

A point separated by 20 mm in the axial direction from the tip end Tp is defined as Tp1, and a region between the tip end Tp and the point Tp1 is defined as a first region. A point separated by 100 mm in the axial direction from the butt end Bt is defined as Bt1, and a region between the butt end Bt and the point Bt1 is defined as a second region. The first region and the second region have a limited influence on the performance of the shaft. In this respect, the full length sheet may not exist in the first region and the second region. Preferably, the full length sheet extends from the tip end Tp to the butt end Bt. In other words, the full length sheet is preferably wholly disposed in the axial direction of the shaft.

In the present application, a layer partially disposed in the axial direction of the shaft is referred to as a partial layer. In the present application, a sheet partially disposed in the axial direction of the shaft is referred to as a partial sheet. The wound partial sheet forms the partial layer. Preferably, the axial direction length of the partial sheet is equal to or less than half the full length of the shaft.

In the present application, the full length layer which is the straight layer is referred to as a full length straight layer. In the embodiment of FIG. 2, the full length straight layers are a layer s6 and a layer s8. The full length straight sheets are a sheet s6 and a sheet s8.

In the present application, the full length layer which is the hoop layer is referred to as a full length hoop layer. In the embodiment of FIG. 2, the full length hoop layer is a layer s7. The full length hoop sheet is the sheet s7.

In the present application, the partial layer which is the straight layer is referred to a partial straight layer. In the embodiment of FIG. 2, the partial straight layers are a layer s1, a layer s4, a layer s5, and a layer s9. Partial straight sheets are the sheet s1, the sheet s4, the sheet s5, and the sheet s9.

In the present application, the partial layer which is the hoop layer is referred to as a partial hoop layer. The embodiment of FIG. 2 does not have the partial hoop layer.

The term "butt partial layer" is used in the present application. Examples of the butt partial layer include a butt partial straight layer and a butt partial hoop layer. In the embodiment of FIG. 2, the butt partial straight layers are the layer s4 and the layer s5. Butt partial straight sheets are the sheet s4 and the sheet s5. In the embodiment of FIG. 2, the butt partial hoop layer is not provided. The butt partial layer can contribute to the adjustment of a ratio (Lg/Ls). The butt partial layer is formed by a butt partial sheet. The ratio (Lg/Ls) is also referred to as a ratio of a center of gravity of the shaft.

An axial direction distance between a butt end of the butt partial layer (butt partial sheet) and the butt end Bt of the shaft is shown by a double-pointed arrow Db in FIG. 2. The axial direction distance Db is preferably equal to or less than 100 mm, more preferably equal to or less than 50 mm, and still more preferably 0 mm. In the embodiment, the axial direction distance Db is 0 mm.

The term "tip partial layer" is used in the present application. An axial direction distance between a tip of the tip partial layer (tip partial sheet) and the tip end Tp of the shaft is shown by a double-pointed arrow Dt in FIG. 2. The axial direction distance Dt is preferably equal to or less than 40 mm, more preferably equal to or less than 30 mm, still more preferably equal to or less than 20 mm, and yet still more preferably 0 mm. In the embodiment, the axial direction distance Dt is 0 mm. The tip partial layer is formed by the tip partial sheet.

Examples of the tip partial layer include a tip partial straight layer. In the embodiment of FIG. 2, the tip partial straight layers are the layer s1 and the layer s9. Tip partial straight sheets are the sheet s1 and the sheet s9. The tip partial layer enhances the strength of a tip portion of the shaft 6. The tip partial layer can contribute to the adjustment of the ratio (Lg/Ls).

The shaft 6 is produced by the sheetwinding method using the sheets shown in FIG. 2.

Hereinafter, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

In the stacking process, the two united sheets described above are produced.

In the stacking process, heating or a press may be used. More preferably, the heating and the press are used in combination. In a winding process to be described later, the deviation of the sheet may be generated during the winding operation of the united sheet. The deviation reduces winding accuracy. The heating and the press improve an adhesive force between the sheets. The heating and the press suppress the deviation between the sheets in the winding process.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The sheets are wound in order from the sheet positioned on the uppermost side in the developed view of FIG. 2. The sheets to be stacked are wound in a state of the united sheet.

A winding body is obtained in the winding process. The winding body is obtained by winding the prepreg sheet around the outside of the mandrel. For example, the winding is achieved by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The tape is wrapped while tension is applied to the tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not limited. However, the process of removing the wrapping tape is preferably performed after the process of extracting the mandrel in respect of improving the efficiency of the process of removing the wrapping tape.

(7) Process of Cutting Both Ends

Both the end parts of the cured laminate are cut in the process. The cutting flattens the end face of the tip end Tp and the end face of the butt end Bt.

In order to facilitate the understanding, in all the developed views of the present application, the sheets after both the ends are cut are shown. In fact, the cutting of both the ends is considered in the setting of the size of each of the sheets. That is, in fact, both end portions to be cut are respectively added to both the end parts of each of the sheets.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to smooth the surface of the cured laminate. Preferably, whole polishing and tip partial polishing are conducted in the polishing process.

(9) Coating Process

The cured laminate after the polishing process is subjected to coating.

The shaft 6 is obtained in the processes. The shaft 6 is lightweight, and has excellent strength. In the shaft 6, a ratio (Lg/Ls) of a center of gravity of the shaft is large. If the ratio of the center of gravity of the shaft is large, easiness of swing can be increased. Therefore, even if a swing balance is large, a head speed can be improved. Both the increase of the head weight and the head speed can be achieved by increasing the ratio of the center of gravity of the shaft.

In respect of the increase of the ratio of the center of gravity of the shaft, the total weight of the butt partial layer is preferably equal to or greater than 5% by weight based on the weight of the shaft, and more preferably equal to or greater than 10% by weight. In respect of suppressing a rigid feeling, the total weight of the butt partial layer is preferably equal to or less than 50% by weight based on the weight of the shaft, and more preferably equal to or less than 45% by weight. In the embodiment of FIG. 2, the total weight of the butt partial layer is the total weight of the sheets s4 and s5.

In respect of the increase of the ratio of the center of gravity of the shaft, the axial direction length of the butt partial layer is preferably equal to or greater than 50 mm, more preferably equal to or greater than 100 mm, and still more preferably equal to or greater than 150 mm. In respect of the increase of the ratio of the center of gravity of the shaft, the axial direction length of the butt partial layer is preferably equal to or less than 500 mm, more preferably equal to or less than 470 mm, and still more preferably equal to or less than 450 mm.

In the embodiment, a carbon fiber (CF) reinforced prepreg and a glass fiber (GF) reinforced prepreg are used. Examples of the carbon fiber include a PAN based carbon fiber and a pitch based carbon fiber. In the embodiment of FIG. 2, the innermost partial sheet s1 is the glass fiber reinforced prepreg. Furthermore, the butt partial sheet s4 is the glass fiber reinforced prepreg. The other sheets are the carbon fiber reinforced prepregs.

In the glass fiber reinforced prepreg, a reinforcing fiber is a glass fiber. In the glass fiber reinforced prepreg of the embodiment, the fiber is oriented substantially in one direction. That is, the glass fiber reinforced prepreg is a UD prepreg. A glass fiber reinforced prepreg other than the UD prepreg may be used. For example, glass fibers contained in the prepreg sheet may be woven.

In the embodiment, the glass fiber reinforced prepreg is used as a straight tip partial layer. The innermost straight tip partial layer s1 is a glass fiber reinforced layer. The sheet s1 is disposed on an inner side with respect to the outermost layer. The sheet s1 is disposed on an inner side with respect to the full length hoop layer s7. The sheet s1 is disposed on an inner side with respect to the bias layers s2 and s3.

A straight tip partial layer s9 is provided on an outer side with respect to the tip partial layer s1. A carbon fiber reinforced prepreg is used for the layer s9. The tip partial layer s9 is disposed on an outer side with respect to the bias layers s2 and s3. The tip partial layer s9 is disposed on an outer side with respect to all the full length straight layers.

The tip partial layer s1 is positioned on an inner side with respect to the bias layers s2 and s3. The shape of the mandrel corresponds to the thickness of the tip partial layer s1. At the position where the tip partial layer s1 is wound, the mandrel is thin. The mandrel is designed so that the outer diameter of the mandrel with the tip partial layer s1 in a state where the tip partial layer s1 is wound is a simple taper shape. Therefore, the generation of wrinkles caused by the tip partial layer s1 is suppressed.

The shaft 6 includes a glass fiber reinforced layer as a straight butt partial layer. The butt partial layer s4 is the glass fiber reinforced layer. The layer s4 is disposed on an outer side with respect to the bias layers s2 and s3. At least one full length straight layer is provided on an outer side with respect to the layer s4.

The straight butt partial layer s5 is provided on an outer side with respect to the butt partial layer s4. The layer s5 is a carbon fiber reinforced layer. The layer s5 is disposed on an outer side with respect to the bias layers s2 and s3. At least one full length straight layer is provided on an outer side with respect to the layer s5.

The shape of the mandrel corresponds to the thickness of the tip partial layer s1. At the position where the tip partial layer s1 is wound, the mandrel is thin. The mandrel is designed so that the outer diameter of the mandrel with the tip partial layer s1 in a state where the tip partial layer s1 is wound is a simple taper shape. Therefore, the generation of wrinkles caused by the tip partial layer s1 is suppressed.

In the present application, the number of the full length sheets is defined as Nw. Preferably, Nw is a natural number equal to or greater than 1. In light of circumferential uniformity, the plurality of full length sheets are preferably dispersed in the circumferential direction. In this respect, Nw is preferably equal to or greater than 3, more preferably equal to or greater than 4, and still more preferably equal to or greater than 5. In respect of weight saving, Nw is preferably equal to or less than 10, more preferably equal to or less than 9, and still more preferably equal to or less than 8.

In the embodiment of FIG. 2, the full length sheets are the sheets s2, s3, s6, s7, and s8. In the embodiment, Nw is 5.

In the present application, the number of the full length straight sheets is defined as Nws. Preferably, Nws is a natural number equal to or greater than 1.

In the embodiment of FIG. 2, the full length straight sheets are the sheets s6 and s8. In the embodiment, Nws is 2.

In the present application, the number of the full length hoop sheets is defined as Nwf. In respect of the shaft strength, Nwf is preferably a natural number equal to or greater than 1.

In the embodiment of FIG. 2, the full length hoop sheet is the sheet s7. In the embodiment, Nwf is 1. In respect of the weight saving, Nwf is preferably equal to or less than 2.

In the present application, the number of the partial sheets is defined as Np. Preferably, Np is a natural number equal to or greater than 1. As described later, preferably, Np is the same as Nw, or less than Nw. In this respect, Np is preferably equal to or less than 6, more preferably equal to or less than 5, and still more preferably equal to or less than 4. In light of the circumferential uniformity, the plurality of partial sheets are preferably dispersed in the circumferential direction. In this respect, Np is preferably equal to or greater than 2.

In the embodiment of FIG. 2, the partial sheets are the sheets s1, s4, s5, and s9. In the embodiment, Np is 4.

In the present application, the number of the tip partial sheets is defined as Npt. In respect of selectively reinforcing the tip part, Npt is preferably a natural number equal to or greater than 1. As described later, preferably, Np is the same as Nw, or less than Nw. In this respect, Npt is preferably equal to or less than 4, and more preferably equal to or less than 3. In respect of the reinforcement of the tip part, Npt is preferably equal to or greater than 1, and more preferably equal to or greater than 2.

In the embodiment of FIG. 2, the tip partial sheets are the sheets s1 and s9. In the embodiment, Npt is 2.

In the present application, the number of the butt partial sheets is defined as Npb. In respect of selectively reinforcing the butt end part, preferably, Npb is a natural number equal to or greater than 1. As described later, Np is preferably the same as Nw, or less than Nw. In this respect, Npb is preferably equal to or less than 3, and more preferably equal to or less than 2.

In the embodiment of FIG. 2, the butt partial sheets are the sheets s4 and s5. In the embodiment, Npb is 2.

Preferably, Nw is equal to or greater than Np. In other words, Nw is preferably the same as Np, or greater than Np. In the embodiment of FIG. 2, Nw is 5, and Np is 4. Therefore, Nw is greater than Np.

Stress is apt to be concentrated on the end of the partial sheet. The axial direction positions of the partial sheets may overlap with each other. Although the overlap portion does not contribute to the shaft strength, the overlap portion increases the weight of shaft. Meanwhile, the stress concentration is suppressed by increasing the full length sheet. The overlap portion described above is not generated in the full length sheet. The improvement in the strength and the weight saving are enabled by Nw≥Np. In this respect, a difference (Nw−Np) is preferably equal to or greater than 1. Particularly, the lightweight shaft has a limitation in Nw. In this respect, the difference (Nw−Np) is preferably equal to or less than 4, and more preferably equal to or less than 3.

In the embodiment, the hoop sheet s7 is the full length sheet. The crushing deformation of the whole shaft is effectively suppressed by the sheet s7.

In the shaft 6, the hoop sheet s7 is the full length sheet. Therefore, the sheet s7 certainly exists at the positions of the ends of all the partial sheets. For this reason, the stress concentration in the end of the partial sheet is eased by the hoop layer. In other words, the deformation in the ends of all the partial sheets is suppressed by the hoop layer.

As described above, the shaft 6 includes the glass fiber reinforced sheets s1 and s4 as the partial sheet. The glass fiber reinforced sheets s1 and s4 are the straight sheets. The shaft 6 includes the glass fiber reinforced sheet s1 as the tip partial sheet. Usually, the elastic modulus of the glass fiber is equal to or greater than about 7 to 8 ton/mm$^2$. The elastic modulus of the glass fiber is comparatively low. An impact-absorbing energy is improved by disposing the glass fiber reinforced layer. Impact caused by hitting a ball mainly acts on the tip part of the shaft 6. The impact of the hitting is effectively absorbed by the glass fiber reinforced layer s1 of the tip part (effect A). The glass fiber reinforced layer s1 enhances the shaft strength.

The axial direction length of the glass fiber reinforced sheet s1 which is the tip partial sheet is shown by a double-pointed arrow T1 in FIG. 2. In respect of the effect A, the length T1 is preferably equal to or greater than 100 mm, more preferably equal to or greater than 125 mm. and still more preferably equal to or greater than 150 mm. The specific gravity of the glass fiber is comparatively large. In respect of the increase of the ratio (Lg/Ls), the length T1 is preferably equal to or less than 350 mm, more preferably equal to or less than 300 mm, and still more preferably equal to or less than 250 mm.

In respect of enhancing the effect A, the glass fiber reinforced sheet s1 preferably includes a tip glass fiber part positioned in the specific tip part Tx. In the embodiment, a part of the glass fiber reinforced sheet s1 is the tip glass fiber part. In the embodiment, the tip glass fiber part is disposed in the whole range in the axial direction of the specific tip part Tx.

Usually, the glass fiber has lower strength than the strength of the PAN based carbon fiber. If the carbon fiber reinforced layer is substituted by the glass fiber reinforced layer, a negative effect in strength may be generated. In the shaft 6, the glass fiber reinforced layer s1 is disposed on a comparatively inner side. The inner layer of the shaft 6 is close to the neutral axis of the section of the shaft (the axis line of the shaft). A tensile stress and a compressive stress which are generated in the inner layer are less than a tensile stress and a compressive stress which are generated in the outer layer. The negative effect in the strength described above is suppressed by disposing the glass fiber reinforced layer on the comparatively inner side (effect B). Meanwhile, the impact-absorbing energy is improved by disposing the glass fiber reinforced layer. The inner side disposal of the glass fiber reinforced layer s1 can enhance the impact-absorbing energy and improve the strength of the shaft 6.

The contribution of the inner layer to the flexural rigidity is smaller than the contribution of the outer layer to the flexural rigidity. The excessive reduction of the flexural rigidity is suppressed by disposing the low-elastic glass fiber on the comparatively inner side. That is, in the shaft 6, an improvement in impact strength is achieved by utilizing the inner layer having a low contribution degree to the flexural rigidity. Therefore, the impact strength is improved while the moderate flexural rigidity is secured (effect C).

In the shaft 6, the glass fiber reinforced sheet s1 is positioned on an inner side with respect to a thickness center position of the shaft. Therefore, the effects B and C are enhanced.

Figure 3:
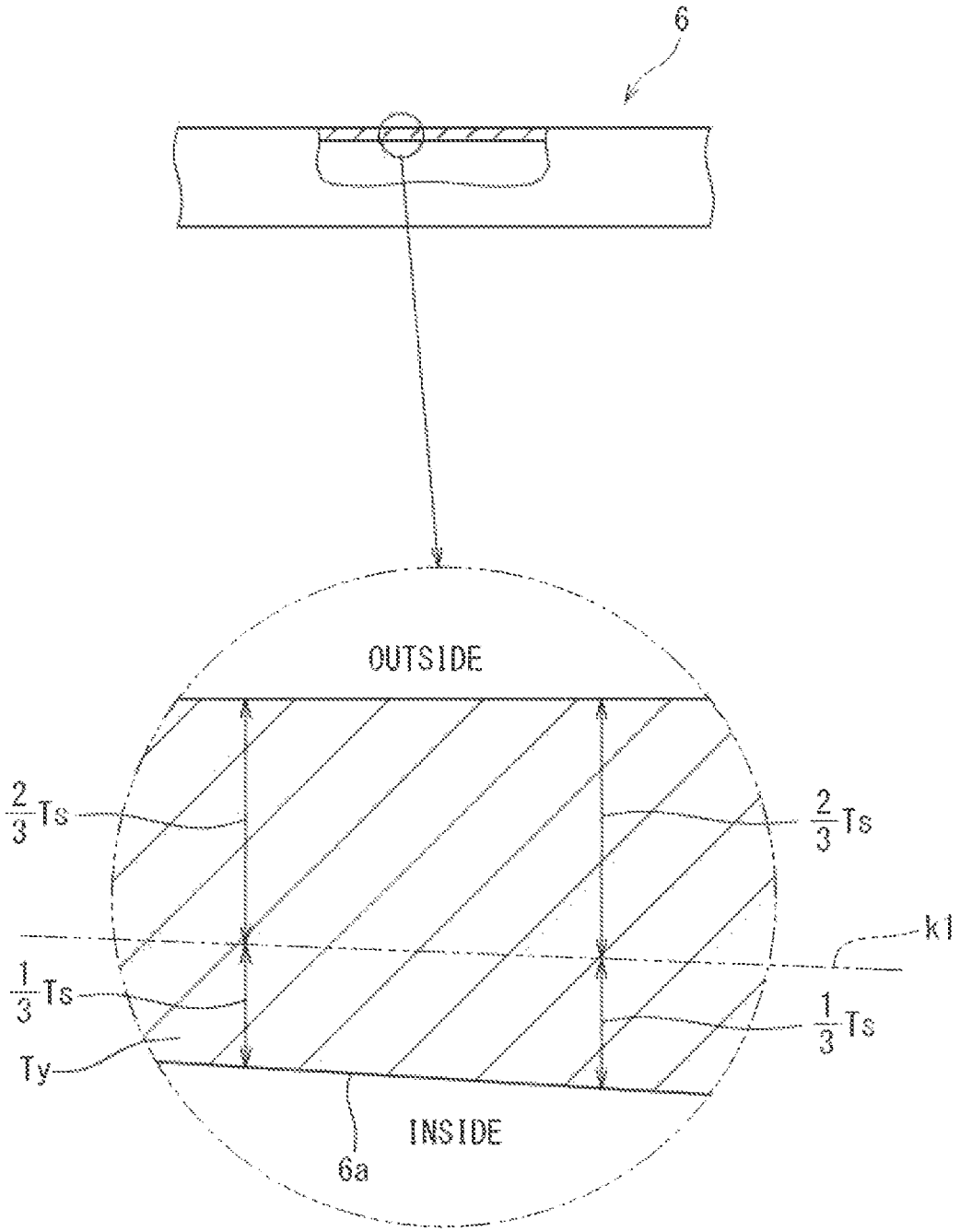
FIG. 3 is a cross-sectional view of the shaft of FIG. 2.

FIG. 3 is a cross-sectional view of the shaft 6. In the present application, the total thickness of the shaft is defined as Ts. The total thickness Ts is measured along the radial direction. The total thickness Ts may be changed depending on the axial direction position. In the present application, a portion having a thickness of Ts/3 from an inner surface 6*a* of the shaft is defined as a specific inner part Ty. In the enlarged view of FIG. 3, the specific inner part Ty is a portion between a boundary surface k1 and the inner surface 6*a*. The thickness of the boundary surface k1 is ⅓ of the total thickness Ts.

In respect of further enhancing the effects B and C, at least one glass fiber reinforced sheet is preferably disposed in the specific inner part Ty. In the embodiment, the whole glass fiber reinforced sheet s4 is disposed in the specific inner part Ty. In the embodiment, the tip glass fiber part is disposed in the specific inner part Ty. The whole tip glass fiber part is disposed in the specific inner part Ty.

In the shaft 6, the glass fiber reinforced sheet s1 forms an innermost layer. In the shaft 6, the glass fiber reinforced sheet s1 includes an innermost layer forming part constituting the inner surface 6*a* of the shaft. Therefore, the effects B and C are further enhanced.

The specific gravity of the glass fiber is greater than the specific gravity of the carbon fiber. The weight saving of the shaft 6 is achieved by using the glass fiber sheet as the partial sheet.

The shaft 6 includes the glass fiber reinforced sheet s4 as the butt partial sheet. The glass fiber sheet s4 having a large specific gravity is disposed in the butt end part. Therefore, the center of gravity G of the shaft approaches the butt end Bt. The glass fiber reinforced sheet s4 can contribute to the increase of the ratio (Lg/Ls) (effect D).

Vibration caused by hitting a ball is transmitted from the tip part of the shaft to the butt end part of the shaft. Furthermore, the vibration is transmitted to golf player's hands through the grip 8 from the butt end part of the shaft. The glass fiber reinforced sheet s4 disposed in the butt end part can effectively absorb the vibration transmitted to the golf player (effect E). The glass fiber reinforced sheet s4 disposed in the butt end part can contribute to an improvement in a ball hitting feeling.

The axial direction length of the glass fiber reinforced sheet s4 which is the butt partial sheet is shown by a double-pointed arrow B1 in FIG. 2. In respect of the effects D and E, the length B1 is preferably equal to or greater than 200 mm, and more preferably equal to or greater than 250 mm. In respect of the weight saving of the shaft 6, the length B1 is preferably equal to or less than 450 mm, more preferably equal to or less than 400 mm, and still more preferably equal to or less than 350 mm.

The shaft 6 has a taper. The outer diameter of the shaft 6 is varied depending on the axial direction position, and the minimum at the tip end Tp. In respect of the conformity with the hosel hole of the head, the outer diameter of the specific tip part Tx is usually equal to or less than 10 mm. In many iron type clubs, the outer diameter of the specific tip part Tx is equal to or less than 9.4 mm. In many wood type clubs, the outer diameter of the specific tip part Tx is equal to or less than 9.0 mm, and preferably equal to or less than 8.5 mm. Thus, the outer diameter of the specific tip part Tx is small.

The hoop layer suppresses the crushing deformation. The crushing deformation is apt to be generated in a portion having a large outer diameter. Therefore, it was said that the hoop layer was effective if the outer diameter was large. However, it has been found that the hoop layer is effective also in the specific tip part Tx having a small outer diameter.

It has been considered that the straight layer was effective in order to improve the strength of the specific tip part Tx having a small outer diameter. However, it has been found that the hoop layer disposed in the specific tip part Tx can improve the strength of the specific tip part Tx.

In the present application, the volume ratio (%) of the hoop layer in the specific tip part Tx is defined as Vf. It has been proven that the strength of the tip part of the shaft is improved by setting the ratio Vf to be equal to or greater than 2.5%. In respect of the strength, the ratio Vf is preferably equal to or greater than 2.5%, more preferably equal to or greater than 2.7%, and still more preferably equal to or greater than 2.8%. Also if the ratio Vf is excessively large, the strength of the tip part of the shaft may be decreased. In this respect, the ratio Vf is preferably less than 10%, more preferably equal to or less than 8%, and still more preferably equal to or less than 6.4%.

If the average thickness of the specific tip part Tx is small, the strength is apt to be decreased. In this case, the effect of improving the strength is conspicuous. In this respect, the average thickness of the specific tip part Tx is preferably equal to or less than 1.8 mm, more preferably equal to or less than 1.7 mm, still more preferably equal to or less than 1.6 mm, and yet still more preferably equal to or less than 1.5 mm. In light of practical strength, the average thickness of the specific tip part Tx is preferably equal to or greater than 1.0 mm, more preferably equal to or greater than 1.1 mm, and still more preferably equal to or greater than 1.2 mm. The average thickness is an average value of the total thickness Ts.

As described above, the toughness of the shaft 6 is enhanced by the glass fiber, and the crushing rigidity of the shaft 6 is enhanced by the hoop layer. The impact strength of the tip part is improved by these synergistic effects. Usually, the hosel end face of the head is positioned in the specific tip part Tx (see FIG. 1). The stress is concentrated on the hosel end face by impact in hitting. The strength of the shaft 6 near the hosel end face is improved by the synergistic effects.

Figure 4:
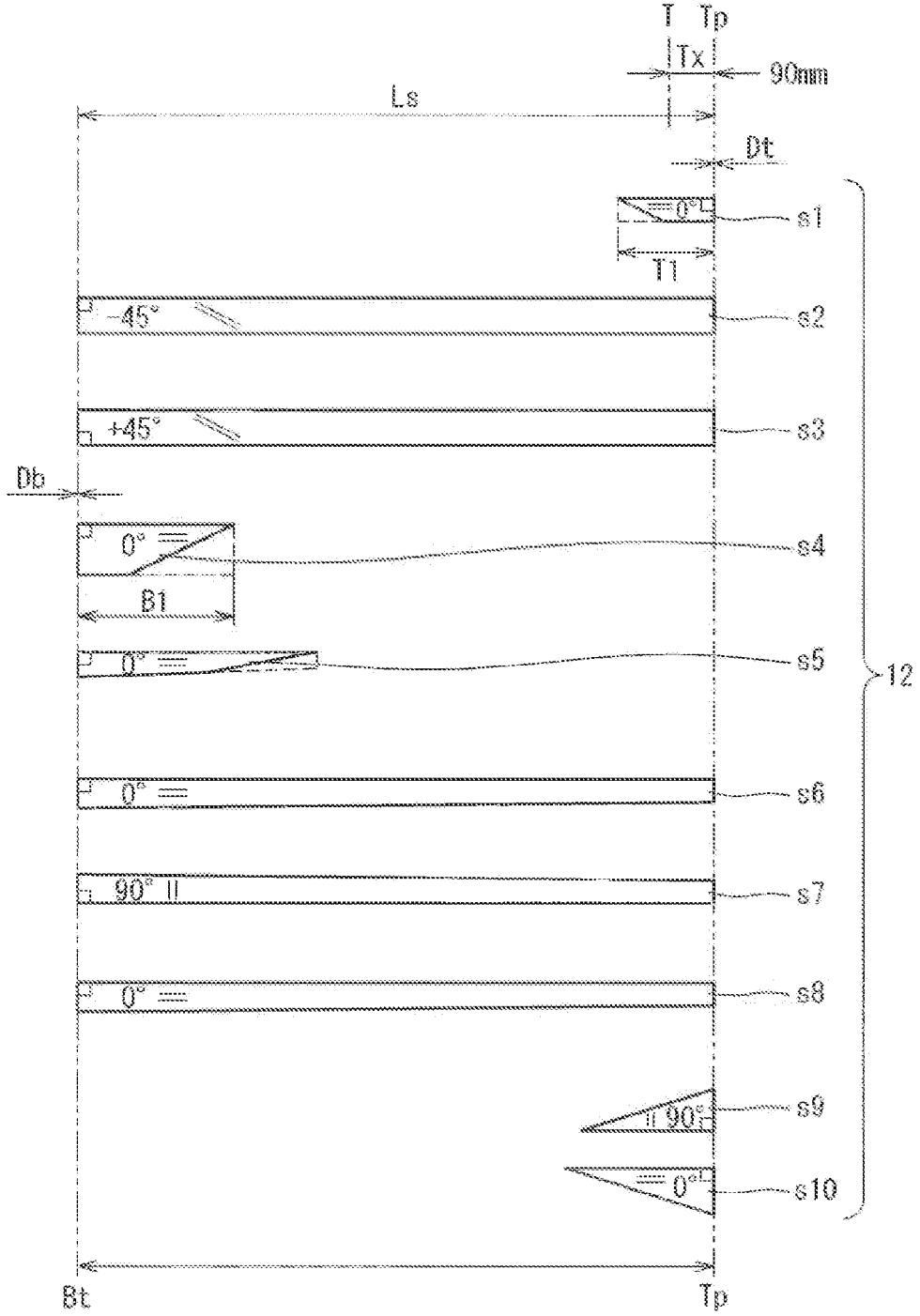
FIG. 4 is a developed view of a shaft according to a second embodiment.

FIG. 4 is a sheet constitution view of a shaft 12 according to another embodiment. The difference between the shaft 12 and the shaft 6 is only the ninth sheet s9. That is, in the shaft 12, the sheet s9 is added to the nine sheets shown in FIG. 2. The ninth sheet s9 in the shaft 6 (FIG. 2) corresponds to a tenth sheet s10 of the embodiment of FIG. 4. The sheet s9 is the hoop sheet. The sheet s9 is the tip partial sheet. The sheet s9 is a tip partial hoop sheet. The sheet s9 is stacked on the tip partial sheet s10, and wound. The ratio Vf can be easily adjusted by the tip partial sheet s9.

The strength of a lightweighter shaft is apt to be decreased. Therefore, an effect of improving the strength is conspicuous in the lightweighter shaft. The embodiment is particularly effective in the lightweight shaft. In this respect, the weight of the shaft is preferably less than 50 g, more preferably equal to or less than 49 g, still more preferably equal to or less than 48 g, yet still more preferably equal to or less than 47 g, and yet still more preferably equal to or less than 46 g. In light of practical strength, the weight of the shaft is preferably equal to or greater than 35 g, and more preferably equal to or greater than 38 g.

In addition to an epoxy resin, a thermosetting resin other than the epoxy resin and a thermoplastic resin or the like may also be used as the matrix resin of the prepreg sheet. In respect of the shaft strength, the matrix resin is preferably the epoxy resin.

[Center of Gravity G of Shaft]

As shown in FIG. 1, the center of gravity G of the shaft is positioned in the shaft 6. The center of gravity G is positioned on the axis line of the shaft. The center of gravity G is the center of gravity of the single shaft 6.

[Full Length Ls of Shaft]

In a shaft which is long and lightweight, the weight of the shaft per unit length is small. In this case, the effect of improving the strength is conspicuous. The shaft which is lightweight and long is effective in the improvement in the head speed. In these respects, the full length Ls of the shaft is preferably equal to or greater than 41 inch, more preferably equal to or greater than 42 inch, still more preferably equal to or greater than 42.5 inch, and yet still more preferably equal to or greater than 43 inch. In respects of easiness of swing and the golf rules, the full length Ls of the shaft is preferably equal to or less than 47 inch.

[Distance Lg between Tip end Tp and Center of Gravity G of Shaft]

If the distance Lg is long, the center of gravity G of the shaft is close to the butt end Bt. The position of the center of gravity can improve the easiness of swing. The position of the center of gravity can contribute to the improvement in the head speed.

In respects of the easiness of swing and the head speed, the distance Lg is preferably equal to or greater than 615 mm, more preferably equal to or greater than 620 mm, still more preferably equal to or greater than 625 mm, and yet still more preferably equal to or greater than 630 mm.

If the center of gravity G of the shaft is too close to the butt end Bt, a centrifugal force acting on the center of gravity G of the shaft is apt to be reduced. That is, if the ratio of the center of gravity of the shaft is large, the centrifugal force acting on the center of gravity G of the shaft is apt to be reduced. In this case, the flexure of the shaft may be less likely to be felt. The shaft of which the flexure is less likely to be felt is apt to cause a rigid feeling. In respect of suppressing the rigid feeling, the distance Lg may be equal to or less than 800 mm.

[Lg/Ls] (Ratio of Center of Gravity of Shaft)

In respects of the easiness of swing and the head speed, the ratio (Lg/Ls) is preferably equal to or greater than 0.54, more preferably equal to or greater than 0.55, and still more preferably equal to or greater than 0.56. If the ratio (Lg/Ls) is excessively large, the shaft strength of the tip part may be reduced. In respect of the shaft strength, the ratio (Lg/Ls) is preferably equal to or less than 0.65, and more preferably equal to or less than 0.64.

Examples of means for adjusting the ratio of the center of gravity of the shaft include the following items (a1) to (a12):

(a1) increase or decrease of the number of windings of the butt partial layer;

(a2) increase or decrease of a thickness of the butt partial layer;

(a3) increase or decrease of an axial direction length of the butt partial layer;

(a4) increase or decrease of a resin content rate of the butt partial layer;

(a5) increase or decrease of a specific gravity of the butt partial layer;

(a6) increase or decrease of the number of windings of the tip partial layer;

(a7) increase or decrease of a thickness of the tip partial layer;

(a8) increase or decrease of an axial direction length of the tip partial layer;

(a9) increase or decrease of a resin content rate of the tip partial layer;

(a10) increase or decrease of a specific gravity of the tip partial layer;

(a11) increase or decrease of a specific gravity of the butt partial layer; and (a12) increase or decrease of a taper ratio of the shaft.

The following Table 1 shows examples of prepregs capable of being used. These prepregs are commercially available. Shafts having desired specifications can be produced by selecting the prepregs.

TABLE 1

Examples of prepregs capable of being used

| Manufacturer | Trade name | Thickness of sheet (mm) | Fiber content rate (% by mass) | Resin content rate (% by mass) | Physical property value of reinforcing fiber: Part number of fiber | Tensile elastic modulus (t/mm$^2$) | Tensile strength (kgf/mm$^2$) |
|---|---|---|---|---|---|---|---|
| Toray Industries, Inc. | 3255S-10 | 0.082 | 76 | 24 | T700S | 24 | 500 |
| Toray Industries, Inc. | 3255S-12 | 0.103 | 76 | 24 | T700S | 24 | 500 |
| Toray Industries, Inc. | 3255S-15 | 0.123 | 76 | 24 | T700S | 24 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Toray Industries, Inc. | 2276S-10 | 0.077 | 80 | 20 | T800S | 30 | 600 |
| Toray Industries, Inc. | 9255S-7A | 0.056 | 78 | 22 | M40S | 40 | 470 |
| Nippon Graphite Fiber Corporation | E1026A-09N | 0.100 | 63 | 37 | XN-10 | 10 | 190 |
| Nippon Graphite Fiber Corporation | E1026A-14N | 0.150 | 63 | 37 | XN-10 | 10 | 190 |
| Mitsubishi Rayon Co., Ltd. | GE352H-160S | 0.150 | 65 | 35 | E Glass | 7 | 320 |
| Mitsubishi Rayon Co., Ltd. | TR350C-100S | 0.083 | 75 | 25 | TR50S | 24 | 500 |
| Mitsubishi Rayon Co., Ltd. | TR350U-100S | 0.078 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | MR350C-075S | 0.063 | 75 | 25 | MR40 | 30 | 450 |
| Mitsubishi Rayon Co., Ltd. | MRX350C-100S | 0.085 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MRX350C-125S | 0.105 | 75 | 25 | MR40 | 30 | 450 |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

The tensile strength and the elastic modulus are measured based on "Testing Methods for Carbon Fibers" specified on JIS R7601: 1986.

EXAMPLES

Hereinafter, the effects of the present invention will be clarified by examples. However, the present invention should not be interpreted in a limited way based on the description of examples.

Laminated constitutions A to H used in examples and comparative examples are respectively shown in the following Tables 2 to 9. Table 2 shows a laminated constitution A. Table 3 shows a laminated constitution B. Table 4 shows a laminated constitution C. Table 5 shows a laminated constitution D. Table 6 shows a laminated constitution E. Table 7 shows a laminated constitution F. Table 8 shows a laminated constitution G. Table 9 shows a laminated constitution H. In each Table, CF means a carbon fiber, and GF means a glass fiber.

TABLE 2

Specifications of laminated constitution A

| | Winding order of sheet | Fiber | Fiber angle Af (degree) | Sheet classification | Tensile elastic modulus of fiber (t/mm$^2$) |
|---|---|---|---|---|---|
| Laminated constitution A | s1 | GF | 0 | Tip partial sheet | 7 |
| | s2 | CF | +45 | Full length sheet | 40 |
| | s3 | CF | −45 | Full length sheet | 40 |

TABLE 2-continued

| Specifications of laminated constitution A | | | | | |
|---|---|---|---|---|---|
| | Winding order of sheet | Fiber | Fiber angle Af (degree) | Sheet classification | Tensile elastic modulus of fiber (t/mm$^2$) |
| | s4 | GF | 0 | Butt partial sheet | 7 |
| | s5 | CF | 0 | Butt partial sheet | 24 |
| | s6 | CF | 0 | Full length sheet | 24~30 |
| | s7 | CF | 90 | Full length sheet | 30 |
| | s8 | CF | 0 | Full length sheet | 24~30 |
| | s9 | CF | 0 | Tip partial sheet | 24 |

TABLE 3

| Specifications of laminated constitution B | | | | | |
|---|---|---|---|---|---|
| | Winding order of sheet | Fiber | Fiber angle Af (degree) | Sheet classification | Tensile elastic modulus of fiber (t/mm$^2$) |
| Laminated constitution B | s1 | CF | +45 | Full length sheet | 40 |
| | s2 | CF | −45 | Full length sheet | 40 |
| | s3 | GF | 0 | Tip partial sheet | 7 |
| | s4 | GF | 0 | Butt partial sheet | 7 |
| | s5 | CF | 0 | Butt partial sheet | 24 |
| | s6 | CF | 0 | Full length sheet | 24~30 |
| | s7 | CF | 90 | Full length sheet | 30 |
| | s8 | CF | 0 | Full length sheet | 24~30 |
| | s9 | CF | 0 | Tip partial sheet | 24 |

TABLE 4

| Specifications of laminated constitution C | | | | | |
|---|---|---|---|---|---|
| | Winding order of sheet | Fiber | Fiber angle Af (degree) | Sheet classification | Tensile elastic modulus of fiber (t/mm$^2$) |
| Laminated constitution C | s1 | CF | +45 | Full length sheet | 40 |
| | s2 | CF | −45 | Full length sheet | 40 |
| | s3 | GF | 0 | Butt partial sheet | 7 |
| | s4 | CF | 0 | Butt partial sheet | 24 |
| | s5 | CF | 0 | Full length sheet | 24~30 |
| | s6 | GF | 0 | Tip partial sheet | 7 |
| | s7 | CF | 90 | Full length sheet | 30 |

TABLE 4-continued

| Specifications of laminated constitution C | | | | | |
|---|---|---|---|---|---|
| | Winding order of sheet | Fiber | Fiber angle Af (degree) | Sheet classification | Tensile elastic modulus of fiber (t/mm$^2$) |
| | s8 | CF | 0 | Full length sheet | 24~30 |
| | s9 | CF | 0 | Tip partial sheet | 24 |

TABLE 5

| Specifications of laminated constitution D | | | | | |
|---|---|---|---|---|---|
| | Winding order of sheet | Fiber | Fiber angle Af (degree) | Sheet classification | Tensile elastic modulus of fiber (t/mm$^2$) |
| Laminated constitution D | s1 | CF | +45 | Full length sheet | 40 |
| | s2 | CF | −45 | Full length sheet | 40 |
| | s3 | GF | 0 | Butt partial sheet | 7 |
| | s4 | CF | 0 | Butt partial sheet | 24 |
| | s5 | CF | 0 | Full length sheet | 24~30 |
| | s6 | CF | 90 | Full length sheet | 30 |
| | s7 | CF | 0 | Full length sheet | 24~30 |
| | s8 | GF | 0 | Tip partial sheet | 7 |
| | s9 | CF | 0 | Tip partial sheet | 24 |

TABLE 6

| Specifications of laminated constitution E | | | | | |
|---|---|---|---|---|---|
| | Winding order of sheet | Fiber | Fiber angle Af (degree) | Sheet classification | Tensile elastic modulus of fiber (t/mm$^2$) |
| Laminated constitution E | s1 | CF | 0 | Tip partial sheet | 10 |
| | s2 | CF | +45 | Full length sheet | 40 |
| | s3 | CF | −45 | Full length sheet | 40 |
| | s4 | GF | 0 | Butt partial sheet | 7 |
| | s5 | CF | 0 | Butt partial sheet | 24 |
| | s6 | CF | 0 | Full length sheet | 24~30 |
| | s7 | CF | 90 | Full length sheet | 30 |
| | s8 | CF | 0 | Full length sheet | 24~30 |
| | s9 | CF | 0 | Tip partial sheet | 24 |

TABLE 7

| Specifications of laminated constitution F | | | | | |
|---|---|---|---|---|---|
| | Winding order of sheet | Fiber | Fiber angle Af (degree) | Sheet classification | Tensile elastic modulus of fiber (t/mm$^2$) |
| Laminated constitution F | s1 | CF | 0 | Tip partial sheet | 10 |
| | s2 | CF | +45 | Full length sheet | 40 |
| | s3 | CF | −45 | Full length sheet | 40 |
| | s4 | CF | 0 | Butt partial sheet | 10 |
| | s5 | CF | 0 | Butt partial sheet | 24 |
| | s6 | CF | 0 | Full length sheet | 24~30 |
| | s7 | CF | 90 | Full length sheet | 30 |
| | s8 | CF | 0 | Full length sheet | 24~30 |
| | s9 | CF | 0 | Tip partial sheet | 24 |

TABLE 8

| Specifications of laminated constitution G | | | | | |
|---|---|---|---|---|---|
| | Winding order of sheet | Fiber | Fiber angle Af (degree) | Sheet classification | Tensile elastic modulus of fiber (t/mm$^2$) |
| Laminated constitution G | s1 | CF | 0 | Tip partial sheet | 10 |
| | s2 | CF | +45 | Full length sheet | 40 |
| | s3 | CF | −45 | Full length sheet | 40 |
| | s4 | CF | 0 | Butt partial sheet | 10 |
| | s5 | CF | 0 | Butt partial sheet | 24 |
| | s6 | CF | 0 | Intermediate partial sheet | 24 |
| | s7 | CF | 90 | Full length sheet | 30 |
| | s8 | CF | 0 | Full length sheet | 24~30 |
| | s9 | CF | 0 | Tip partial sheet | 24 |

TABLE 9

| Specifications of laminated constitution H | | | | | |
|---|---|---|---|---|---|
| | Winding order of sheet | Fiber | Fiber angle Af (degree) | Sheet classification | Tensile elastic modulus of fiber (t/mm$^2$) |
| Laminated constitution H | s1 | GF | 0 | Tip partial sheet | 7 |
| | s2 | CF | +45 | Full length sheet | 40 |
| | s3 | CF | −45 | Full length sheet | 40 |
| | s4 | GF | 0 | Butt partial sheet | 7 |

TABLE 9-continued

| Specifications of laminated constitution H | | | | | |
|---|---|---|---|---|---|
| | Winding order of sheet | Fiber | Fiber angle Af (degree) | Sheet classification | Tensile elastic modulus of fiber (t/mm$^2$) |
| | s5 | CF | 0 | Butt partial sheet | 24 |
| | s6 | CF | 0 | Full length sheet | 24~30 |
| | s7 | CF | 90 | Full length sheet | 30 |
| | s8 | CF | 0 | Full length sheet | 24~30 |
| | s9 | CF | 90 | Tip partial sheet | 30 |
| | s10 | CF | 0 | Tip partial sheet | 24 |

The laminated constitution A (Table 2) is shown in FIG. 2.

The laminated constitution B (Table 3) is the same as the laminated constitution A except that a tip partial sheet s1 is moved to a third sheet s3. A constitution in which the sheet s1 of FIG. 2 is moved to a third position from the top is the laminated constitution B.

The laminated constitution C (Table 4) is the same as the laminated constitution A except that the tip partial sheet s1 is moved to a sixth sheet s6. A constitution in which the sheet s1 of FIG. 2 is moved to a sixth position from the top is the laminated constitution C.

The laminated constitution D (Table 5) is the same as the laminated constitution A except that the tip partial sheet s1 is moved to an eighth sheet s8. A constitution in which the sheet s1 of FIG. 2 is moved to an eighth position from the top is the laminated constitution D.

The laminated constitution E (Table 6) is the same as the laminated constitution A except that the tip partial sheet s1 is substituted by a carbon fiber reinforced prepreg. Therefore, the laminated constitution E is as shown in FIG. 2. The fiber elastic modulus of the prepreg used for the substitution is 10 t/mm$^2$, and close to the elastic modulus of the glass fiber.

The laminated constitution F (Table 7) is the same as the laminated constitution A except that the sheets s1 and s4 are substituted by the carbon fiber reinforced prepreg. Therefore, the laminated constitution F is as shown in FIG. 2. The fiber elastic moduli of the prepregs used for the substitution are 10 t/mm$^2$, and close to the elastic modulus of the glass fiber.

Figure 5:
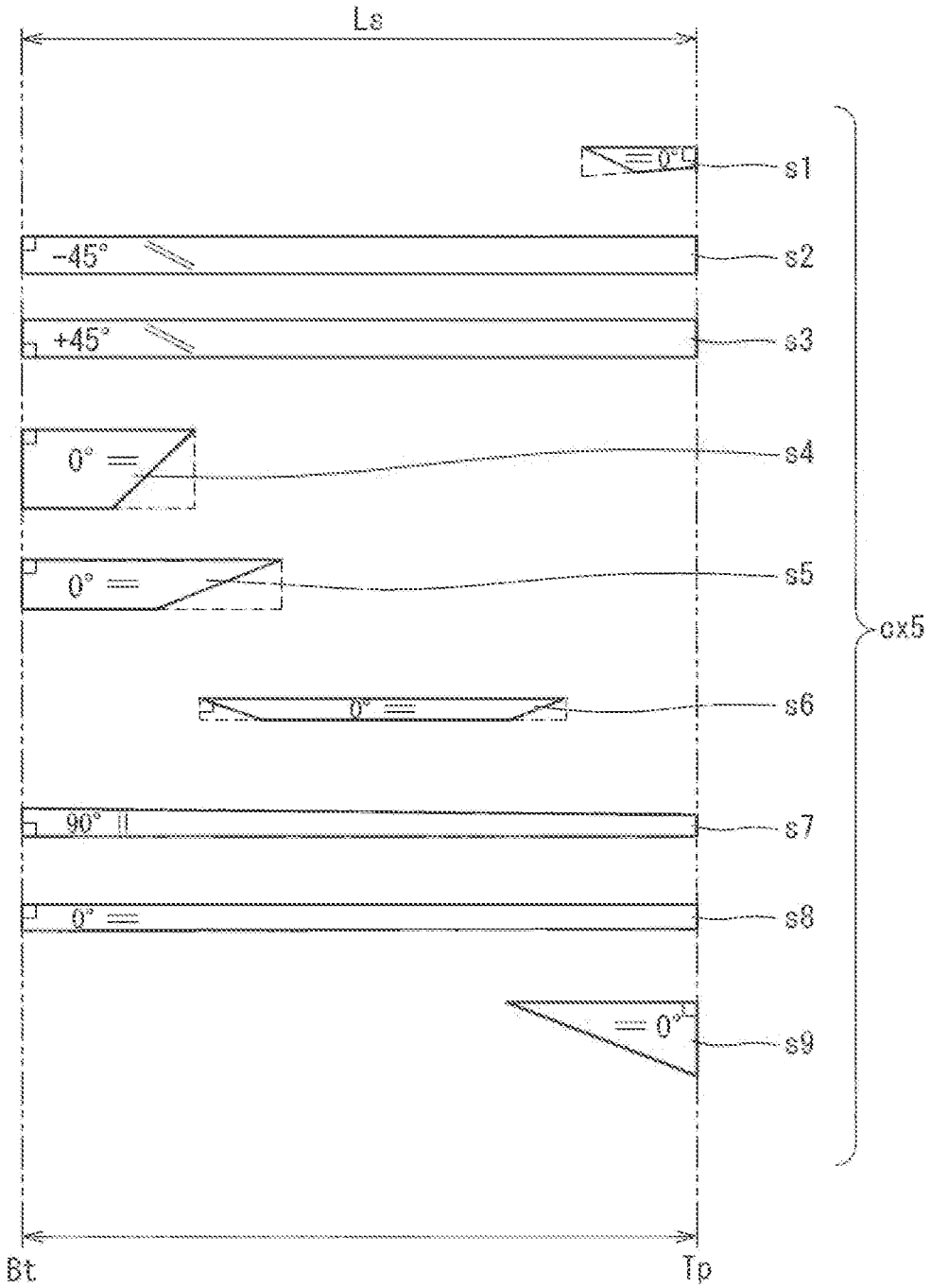
FIG. 5 is a developed view of a shaft of comparative example 5.

FIG. 5 shows the laminated constitution of the laminated constitution G (Table 8). FIG. 5 is a sheet developed view of a shaft cx5 according to comparative example 5.

The laminated constitution H (Table 9) is as shown in FIG. 4.

Example 1

A shaft having the same laminated constitution as the laminated constitution of the shaft 6 was produced. That is, a shaft having the sheet constitution shown in FIG. 2 was produced. The laminated constitution A (Table 2) was employed. Trade names of prepregs used for sheets are as follows.

sheet s1: GE352H-160S (manufactured by Mitsubishi Rayon Co., Ltd.)

sheet s2: 9255S-7A (manufactured by Toray Industries, Inc.)

sheet s3: 9255S-7A (manufactured by Toray Industries, Inc.)

sheet s4: GE352H-160S (manufactured by Mitsubishi Rayon Co., Ltd.)

sheet s5: 3255S-10 (manufactured by Toray Industries, Inc.)

sheet s6: 3255S-10 (manufactured by Toray Industries, Inc.)

sheet s7: 805S-3 (manufactured by Toray Industries, Inc.)

sheet s8: 3255S-15 (manufactured by Toray Industries, Inc.)

sheet s9: 3255S-10 (manufactured by Toray Industries, Inc.)

The trade name "GE352H-160S" is a glass fiber reinforced prepreg. A glass fiber is E glass, and the tensile elastic modulus of the glass fiber is 75 GPa (7.65 ton/mm$^2$).

The shaft of example 1 was obtained as in the shaft 6 using the manufacturing method described above. The full length Ls of the shaft was 1168 mm. A forward flex was 150 mm (±3 mm). A backward flex was 140 mm (±3 mm). The specifications and evaluation results of example 1 are shown in the following Table 10.

In all the following examples and comparative examples, the forward flex and the backward flex were adjusted so as to be the same as the forward flex and the backward flex of example 1. The adjustment was achieved by changing the fiber elastic modulus of a full length straight layer and/or changing the thickness of the full length straight layer. The forward flex and the backward flex were adjusted by selecting a suitable prepreg from a plurality of prepregs shown in Table 1.

Examples 2 to 5

Shafts of examples 2 to 5 were obtained in the same manner as in example 1 except formatters shown in Table 10. The kinds and sizes of prepregs were adjusted so as to obtain desired specifications. The volume of a hoop layer in a specific tip part was adjusted by the number of plies of a hoop sheet. The specifications and evaluation results of these examples are shown in the following Table 10.

Examples 6 to 10

Shafts of examples 6 to 10 were obtained in the same manner as in example 1 except formatters shown in Table 11. The kinds and sizes of prepregs were adjusted so as to obtain desired specifications. The volume of a hoop layer in a specific tip part in examples 6 to 8 was adjusted by the number of plies of a hoop sheet. In examples 9 and 10, the volume of a hoop layer in a specific tip part was adjusted by the size of a tip partial hoop sheet. The tip partial hoop sheet is a sheet s9 in FIG. 4. The specifications and evaluation results of these examples are shown in the following Table 11.

Comparative Examples 1 to 5

Shafts of comparative examples 1 to 5 were obtained in the same manner as in example 1 except for matters shown in Table 12. The kinds and sizes of prepregs were adjusted so as to obtain desired specifications. The volume of a hoop layer in a specific tip part in comparative examples 1 to 5 was adjusted by the number of plies of a hoop sheet. The specifications and evaluation results of these comparative examples are shown in the following Table 12.

TABLE 10

Evaluation results of specifications of examples

| | | Example 1 | Example 2 | Example 3 | Example 4 | Example 5 |
|---|---|---|---|---|---|---|
| Laminated constitution | | A | A | A | B | C |
| Number of full length sheets Nw | | 5 | 5 | 5 | 5 | 5 |
| Number of partial sheet Np | | 4 | 4 | 4 | 4 | 4 |
| Position ratio Pg (%) | Tip | 0% | 0% | 0% | 22% | 33% |
| | Point T separated, by 90 mm from tip | 0% | 0% | 0% | 27% | 40% |
| | Average | 0% | 0% | 0% | 24% | 36% |
| Volume of specific tip part (mm$^3$) | | 2800 | 2800 | 2500 | 2800 | 2800 |
| Volume of hoop layer in specific tip part (mm$^3$) | | 80 | 160 | 160 | 80 | 80 |
| Volume ratio Vf (%) | | 2.86 | 5.71 | 6.40 | 2.86 | 2.86 |
| Weight of shaft (g) | | 44 | 44 | 43 | 44 | 44 |
| Distance Lg (mm) | | 630 | 630 | 640 | 630 | 630 |
| Three-point flexural strength at point T (kgf) | | 220 | 215 | 205 | 215 | 213 |
| Impact-absorbing energy (J) | | 3.7 | 3.6 | 3.5 | 3.5 | 3.4 |

TABLE 11

Evaluation results of specifications of examples

| | | Example 6 | Example 7 | Example 8 | Example 9 | Example 10 |
|---|---|---|---|---|---|---|
| Laminated constitution | | D | E | A | H | H |
| Number of full length sheets Nw | | 5 | 5 | 5 | 5 | 5 |
| Number of partial sheet Np | | 4 | 4 | 4 | 5 | 5 |
| Position ratio Pg (%) | Tip | 44% | — | 0% | 0% | 0% |
| | Point T separated by 90 mm from tip | 52% | — | 0% | 0% | 0% |
| | Average | 48% | — | 0% | 0% | 0% |
| Volume of specific tip part ($mm^3$) | | 2800 | 2800 | 2800 | 2800 | 2800 |
| Volume of hoop layer in specific tip part ($mm^3$) | | 80 | 80 | 60 | 225 | 286 |
| Volume ratio Vf (%) | | 2.86 | 2.86 | 2.14 | 8.04 | 10.21 |
| Weight of shaft (g) | | 44 | 44 | 44 | 44 | 44 |
| Distance Lg (mm) | | 630 | 630 | 630 | 630 | 630 |
| Three-point flexural strength at point T (kgf) | | 210 | 220 | 200 | 210 | 205 |
| Impact-absorbing energy (J) | | 3.3 | 3.2 | 3.4 | 3.5 | 3.4 |

TABLE 12

Evaluation results of specifications of comparative examples

| | | Comparative Example 1 | Comparative Example 2 | Comparative Example 3 | Comparative Example 4 | Comparative Example 5 |
|---|---|---|---|---|---|---|
| Laminated constitution | | F | F | F | F | G |
| Number of full length sheets Nw | | 5 | 5 | 5 | 5 | 4 |
| Number of partial sheet Np | | 4 | 4 | 4 | 4 | 5 |
| Position ratio Pg (%) | Tip | — | — | — | — | — |
| | Point T separated by 90 mm from tip | — | — | — | — | — |
| | Average | — | — | — | — | — |
| Volume of specific tip part ($mm^3$) | | 2500 | 2800 | 3100 | 3400 | 2800 |
| Volume of hoop layer in specific tip part ($mm^3$) | | 160 | 80 | 80 | 80 | 80 |
| Volume ratio Vf (%) | | 6.40 | 2.86 | 2.58 | 2.35 | 2.86 |
| Weight of shaft (g) | | 43 | 44 | 45 | 46 | 45 |
| Distance Lg (mm) | | 635 | 625 | 615 | 605 | 620 |
| Three-point flexural strength at point T (kgf) | | 185 | 220 | 230 | 235 | 200 |
| Impact-absorbing energy (J) | | 2.8 | 3.2 | 3.2 | 3.2 | 3.2 |

A position ratio Pg is shown in Tables 10 to 12. The position ratio Pg represents a radial position of a glass fiber reinforced sheet. The position ratio Pg is represented by percent. The position ratio Pg is a ratio of the innermost position of the glass fiber reinforced sheet to the total thickness Ts. The glass fiber reinforced sheet is closer to the inner surface of the shaft as the value of the position ratio Pg is smaller. If the position ratio Pg is 0%, the glass fiber reinforced sheet forms the innermost layer.

The position ratio Pg is a position in a specific tip part Tx. The position ratio Pg may be varied depending on an axial direction position. Preferably, the position ratio Pg is set to be equal to or less than 33.3% at all the axial direction positions in the specific tip part Tx.

[Evaluation Methods]

[Three-Point Flexural Strength at Point T]

Figure 6:
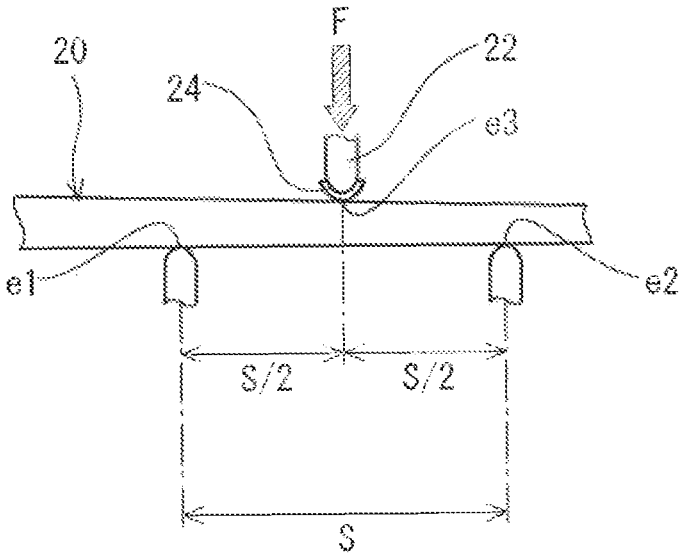
FIG. 6 is schematic view showing a method for measuring a three-point flexural strength.

The three-point flexural strength is based on an SG type three-point flexural strength test. This is a test set by Consumer Product Safety Association in Japan. FIG. 6 shows a measuring method of the three-point flexural strength test. A measured point is a point T. As described above, the point T is a point separated by 90 mm from the tip end Tp.

As shown in FIG. 6, a load F is applied downward from above at a load point e3 while a shaft 20 is supported from below at two supporting points e1 and e2. The load point e3 is positioned at a position bisecting the distance between the supporting points e1 and e2. The load point e3 is the measured point. If the point T is measured, the span S is set to 150 mm. A value (peak value) of the load F when the shaft 20 is broken is measured. The values are shown in Tables 10 to 12.

[Method for Measuring Impact-Absorbing Energy]

Figure 7:
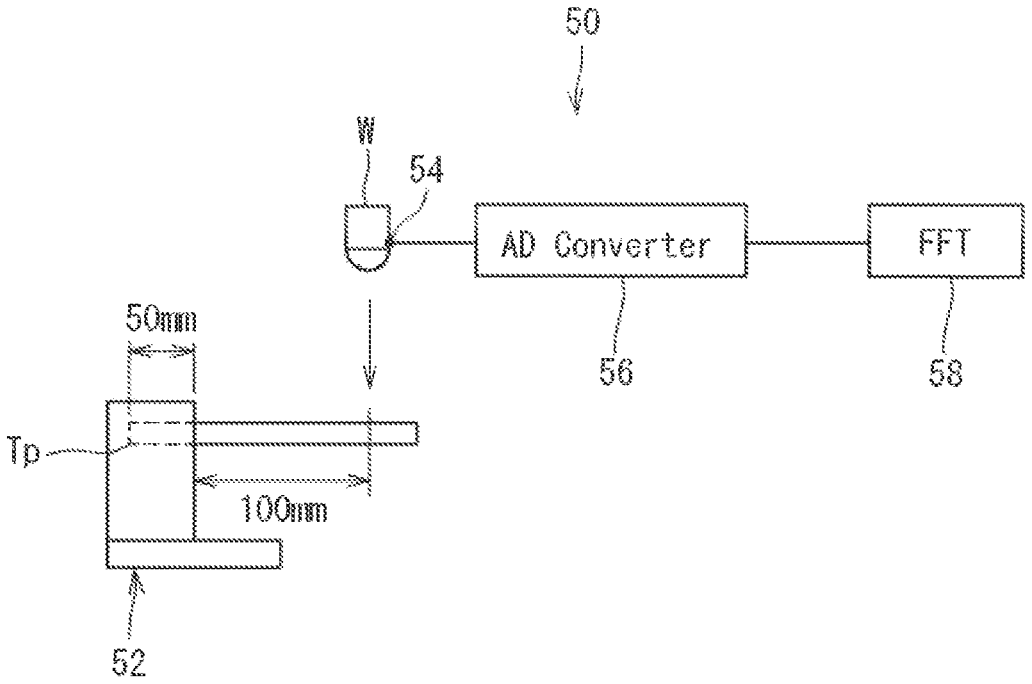
FIG. 7 is a schematic view showing a method for measuring an impact-absorbing energy.

FIG. 7 shows a method for measuring an impact-absorbing energy. An impact test was conducted by a cantilever bending method. A drop weight impact tester (IITM-18) manufactured by Yonekura MFG Co., Ltd. was used as a measuring apparatus 50. A tip part between a tip end Tp of the shaft and a position separated by 50 mm from the tip end Tp was fixed to a fixing jig 52. A weight W of 600 g was dropped to the shaft at a position separated by 100 mm from the fixed end, from the upper side at 1500 mm above the position. An accelerometer 54 was attached to the weight W. The accelerometer 54 was connected to an FFT analyzer 58 through an AD converter 56. A measurement wave profile was obtained by FFT treatment. Displacement D and an impact flexural load L were measured by the measurement to calculate an impact-absorbing energy before breakage started.

Figure 8:
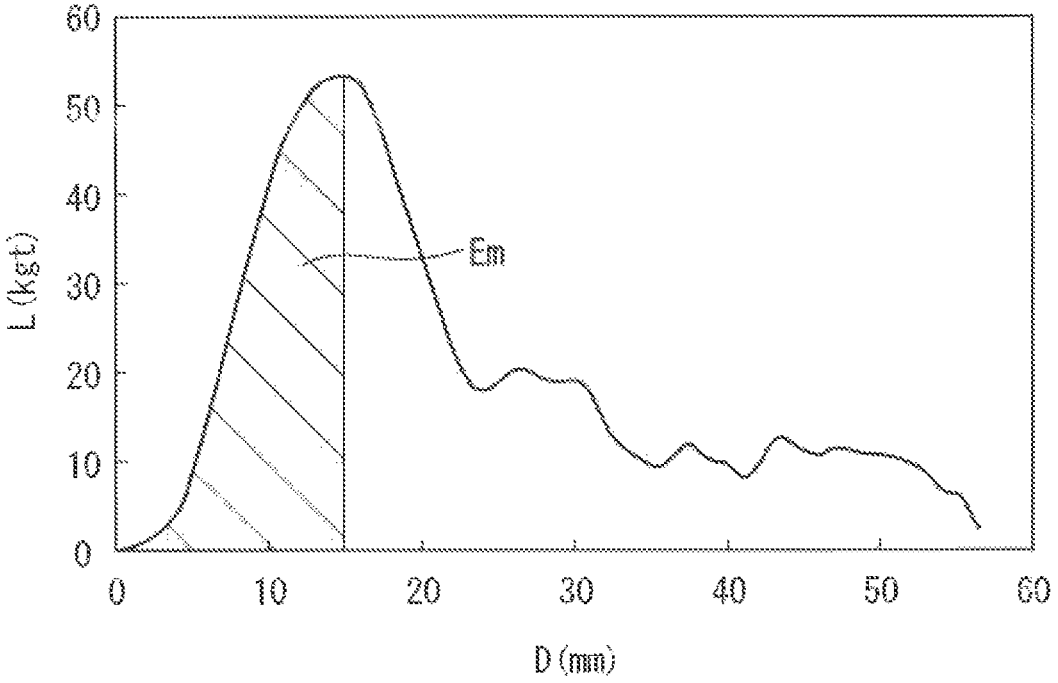
FIG. 8 is a graph showing an example of a wave profile obtained when the impact-absorbing energy is measured.

FIG. 8 is an example of the measured wave profile. The wave profile is a graph showing the relationship between the displacement D (mm) and the impact flexural load L (kgf). In the graph of FIG. 8, the area of a portion shown by hatching represents an impact-absorbing energy Em (J). The values of the energies Em are shown in Tables 10 to 12.

[Hitting Feeling Evaluation]

Five testers having a handicap of 10 to 20 compared the shaft of example 7 with the shaft of comparative example 2. A head and a grip were attached to each of these shafts to obtain a test club. A head "XXIO 7, loft 10.5 degrees" manufactured by Dunlop Sports Co., Ltd. was used. Each of the testers hit ten golf balls with each of the clubs. "SRIXON Z-STAR" manufactured by Dunlop Sports Co., Ltd. was used as the ball. Sensory evaluation was conducted at five stages of a score of one to five. The higher the score is, the higher the evaluation is. The average score of the five testers in example 7 was 4.5. The average score of the five testers in comparative example 2 was 2.3. The hitting feeling was improved by using the glass fiber reinforced layer as the butt partial layer.

Thus, the examples are highly evaluated as compared with the comparative examples. The examples are lightweight, have a tip part having excellent strength, and have a large distance Lg. The advantages of the present invention are apparent.

The shaft described above can be used for all golf clubs.

The description hereinabove is merely for an illustrative example, and various modifications can be made in the scope not to depart from the principles of the present invention.

What is claimed is:

1. A golf club shaft comprising a plurality of prepreg sheets, wherein the prepreg sheets include a full length sheet, and a partial sheet partially provided in an axial direction of the shaft;

the full length prepreg sheet comprising a full length hoop sheet and a full length straight sheet, wherein the full length hoop sheet is a carbon fiber reinforced sheet and the full length straight sheet is a carbon fiber reinforced sheet; and the partial prepreg sheet comprising a glass fiber reinforced sheet that is a uni-direction prepreg in which the glass fiber is oriented substantially in one direction, wherein the glass fiber reinforced sheet includes a tip glass fiber part positioned in the specific tip portion;

wherein a point separated by 90 mm from a tip end of the shaft is defined as T, with a region between the point T and the tip end of the shaft being defined as a specific tip portion, and wherein a volume ratio Vf of a hoop layer in the specific tip portion is 2.5% or greater and less than 10%.

2. The golf club shaft according to claim 1, wherein if a total thickness of the shaft is defined as Ts, and a portion having a thickness of Ts/3 from an inner surface of the shaft is defined as a specific inner part, the at least one glass fiber reinforced sheet is disposed in the specific inner part.

3. The golf club shaft according to claim 1, wherein the glass fiber reinforced sheet includes an innermost layer forming part constituting an inner surface of the shaft.

4. The golf club shaft according to claim 1, wherein a weight of the shaft is less than 50 g.

5. The golf club shaft according to claim 1, wherein the partial sheet includes a butt partial sheet;

the butt partial sheet forms a butt partial layer; and a total weight of the butt partial layer is 5% by weight or greater and 50% by weight or less based on a weight of the shaft.

6. The golf club shaft according to claim 5, wherein an axial direction length of the butt partial layer is 50 mm or greater and 500 mm or less.

7. The club shaft according to claim 1, wherein the glass fiber reinforced sheet is straight sheet.

8. The golf club shaft according to claim 1, wherein the glass fiber reinforced sheet includes a tip partial sheet; and an axial direction length of the glass fiber reinforced sheet as the tip partial sheet is 100 mm or greater and 350 mm or less.

9. The golf club shaft according to claim 1, wherein the glass fiber reinforced sheet includes a butt partial sheet.

10. The golf club shaft according to claim 9, wherein an axial direction length of the glass fiber reinforced sheet as the butt partial sheet has is 200 mm or greater and 450 mm or less.

11. The golf club shaft according to claim 1, wherein an outer diameter of the specific tip portion is equal to or less than 10 mm.

12. The golf club shaft according to claim 1, wherein an average thickness of the tip portion is 1.0 mm or greater and 1.8 mm or less.

13. The golf club shaft according to claim 1, wherein a full length of the shaft is 41 inch or greater and 47 inch or less.

14. The golf club shaft according to claim 1, wherein if a distance between the tip of the shaft and a center of gravity of the shaft is defined as Lg, and a full length of the shaft is defined as Ls, Lg/Ls is 0.54 or greater and 0.65 or less.

* * * * *